United States Patent [19]

Wright et al.

[11] Patent Number: 4,881,848

[45] Date of Patent: Nov. 21, 1989

[54] METHOD OF FORMING AN IMMERSED DAM FOUNDATION AND A DAM STRUCTURE THEREON

[75] Inventors: Everald V. Wright, Pittsburgh; Thomas L. Manley, Jr., Coraopolis, both of Pa.

[73] Assignee: Davy McKee Corporation, Pittsburgh, Pa.

[21] Appl. No.: 224,140

[22] Filed: Jul. 26, 1988

[51] Int. Cl.[4] ..... E02B 7/02

[52] U.S. Cl. ..... 405/116; 405/107; 405/114

[58] Field of Search ..... 405/116, 107, 110, 111, 405/114, 205, 207, 209

[56] References Cited

U.S. PATENT DOCUMENTS

| | | | |
|---|---|---|---|
| 1,628,933 | 5/1927 | Troiel | 405/114 X |
| 3,342,033 | 9/1967 | Crouch et al. | 405/116 X |
| 3,718,002 | 2/1973 | Aubert | 405/102 |
| 3,720,067 | 3/1973 | Aubert | 405/107 |
| 3,775,983 | 12/1973 | Aubert | 405/102 |
| 3,938,342 | 2/1976 | Aubert | 405/225 |
| 4,352,592 | 10/1982 | Aubert | 405/102 |
| 4,704,052 | 11/1987 | Aubert | 405/107 X |

OTHER PUBLICATIONS

"le nouveau barrage de denouval" dated Sep. 1980 by J. Aubert.

*Primary Examiner*—Dennis L. Taylor
*Assistant Examiner*—J. Russell McBee
*Attorney, Agent, or Firm*—Parmelee, Miller, Welsh & Kratz

[57] ABSTRACT

An immersed dam foundation and a dam structure are formed in a body of moving water by forming a plurality of spaced piers having temporary support posts thereon. A current deflector is secured to the upstream support posts and sheet piling walls are driven to form upstream and downstream walls between the piers forming a base therebetween. The base is covered with a tremie seal and the walls cut off so that a prefabricated dam structure can be floated to a location above the tremie seal and lowered onto anchor points on the adjacent piers and secured to the piers and tremie seal. An exposed face of a pier is protected from the currents by barriers that serve as a portion of the next upstream and downstream walls, with gravel covered by precast concrete pads. The access galleries of adjacent prefabricated dam structures are closely aligned and seals provided therebetween.

23 Claims, 7 Drawing Sheets

METHOD OF FORMING AN IMMERSED DAM FOUNDATION AND A DAM STRUCTURE THEREON

FIELD OF THE INVENTION

The present method relates to the construction of immersed dam foundations in a body of moving water and the formation of a dam structure on the immersed dam foundation without the need for constructing large and costly cofferdams in the body of moving water.

BACKGROUND OF THE INVENTION

In the formation of dams, such as movable wicket dams, across a body of moving water, such as a river or tidal inlet, costly and time consuming procedures are normally required. Normally, in such dam formations, large areas of the body of moving water are separated from the remainder by the construction of large cofferdams. After construction of a cofferdam, which is generally formed by sections of sheet metal piling which cooperate with each other to form a watertight enclosure, the interior of the cofferdam has the water pumped therefrom to expose the bed or floor of the body of water within the cofferdam, and construction of a permanent foundation and other superimposed structure is effected under dry conditions. By isolating a large dry area, dredging or removal of a portion of the bed may be effected within the enclosure and a solid concrete or masonry structure can be formed on the dredged area.

Such "dry" methods of construction involve the use of large field labor forces which may not be locally available. Such cofferdams are not only expensive to construct, but they must remain in place for a long period of time, which restricts water flow substantially over long periods of high river flow and requires a long overall construction period. Also, such a construction method often requires the closing off of substantial areas of a river, thereby progressively increasing the flow of water through an ever-decreasing gap in the river until the drop of river level across the dam area is so great that lockage of river traffic is required, even during low water conditions.

The use of prefabricated wicket dams and the placement of said wicket dams on immersed foundations have been proposed, as in U.S. Pat. Nos. 3,720,067; 3,775,983; 3,938,342 and 4,352,592, all of which issued to Jean Aubert. These patents describe a system of remotely fabricated wickets to be built and made operative on a remotely fabricated sill which is then brought to the site, submerged into a prepared sheetpile wall foundation, and secured into position with concrete, using underwater concreting techniques, and avoids extensive cofferdaming systems. While such a method is effective, it is primarily concerned with formation of a dam that comprises a single prefabricated sill and wicket system that is secured to a single foundation, and does not address the problems of multiple sill sections of a dam constructed across a wide expanse of a body of moving water with highly fluctuating water levels and velocities or large volumes of sediments or debris moving with the water.

It is an object of the present invention to incorporate a series of generally known and proven techniques into an overall system to provide the means to simplify and speed construction of large dams without the necessity of blocking off large areas of a body of moving water for extended periods of time, and a means to use effectively prefabricated units to provide the movable parts of the dam for ultimate water control, in a manner to provide for highly fluctuating water levels and velocities and/or silt loads.

SUMMARY OF THE INVENTION

An immersed dam foundation and a dam structure are formed in a body of moving water, such as a river, by first forming a plurality of laterally spaced support piers. The piers are constructed with a cofferdam below the surface of the water and have stable anchor points, with sheet piling around the perimeter of the piers. Temporary support posts are constructed on the upstream and downstream ends of each pier, and an upstream current deflector is installed between adjacent piers which is supported by the upstream temporary support posts and deflects the current and silt loads around the area between the piers.

An upstream wall and a downstream wall between the adjacent piers are formed by driving sheet pile into the floor of the river proximate the upstream and downstream temporary support posts, respectively. The area between the two walls and the adjacent piers is then dredged, if necessary, to form a depression which is at least partially filled with a concrete seal poured underwater (tremie), which tremie seal and adjacent piers serve as an immersed dam foundation. After the walls are cut off flush with the piers, a prefabricated dam structure is floated to a location above the tremie seal and lowered onto the stable anchor points on the piers and is then secured to the piers and tremie seal by use of structural tremie concrete to form a dam.

During positioning of the prefabricated dam structure, the temporary support posts may have control lines attached thereto, and during securement of the prefabricated dam structure to the foundation a crushable seal, such as a foamed thermoplastic member, may be positioned between the edges of the cut-off wall and the underside of a platform of the prefabricated dam structure.

If construction is to be interrupted for a long time period, the floor of the body of moving water at the outside pier and exposed side face of the outside pier are protected from erosion by scouring in a manner such that the future upstream nd downstream walls to the next pier can be readily built. A sloped gravel layer is deposited between upstream and downstream sheet pile barriers, and closed at the outboard end with a wall parallel to the flow and braced with a temporary steel frame. These barriers serve as a section of the next upstream and downstream walls, and extend outwardly an adequate distance from the exposed pier face. The gravel is covered with precast concrete pads and riprap is deposited adjacent to, and outside of, the upstream and downstream sheet pile barriers near the pier.

Each prefabricated dam section preferably has access and cylinder service galleries through the length thereof, with a communicating passageway between the galleries of the prefabricated dam section closed by pairs of watertight bulkheads which can serve as locks if one gallery is dry and the other full of water. The adjacent prefabricated dam sections are positioned with their galleries in closely spaced alignment with a gap therebetween and a gallery seal is provided across the gap between adjacent galleries. The gallery seal may comprise a slidable conduit positioned in a recess in one end of an adjacent prefabricated dam section which closes off the gap in connection with inflatable seals and with grout or flexible sealing material completely sealing the gap outside the conduit. In another embodiment of a gallery seal, shoulders are formed in the ends of adjacent dam sections and compressible rubber seals are positioned between metal flanges secured in the shoulders, with connecting bolts used to compress the rubber seals to seal the gap. In a further embodiment of the gallery seal, channels are formed in the wall at one end of a prefabricated dam section and a flexible member with compressible seals is compressed, such as by use of jacks to move the flexible member in the direction of the adjacent prefabricated dam section so as to compress the seals and seal the gap, the jacks being then replaced by permanent shims.

DESCRIPTION OF THE DRAWINGS

The invention will be more readily understood by reference to the accompanying drawings wherein.

DETAILED DESCRIPTION

According to the present method, an immersed dam foundation and dam structure thereon are formed by a method which maximizes the amount of work that can be accomplished during a construction season and minimizes construction costs and the massiveness of foundations. The method also permits river traffic to bypass the locks during normal and high water flow throughout the entire construction period while maximizing the use of off-site prefabricated materials.

Figure 1:
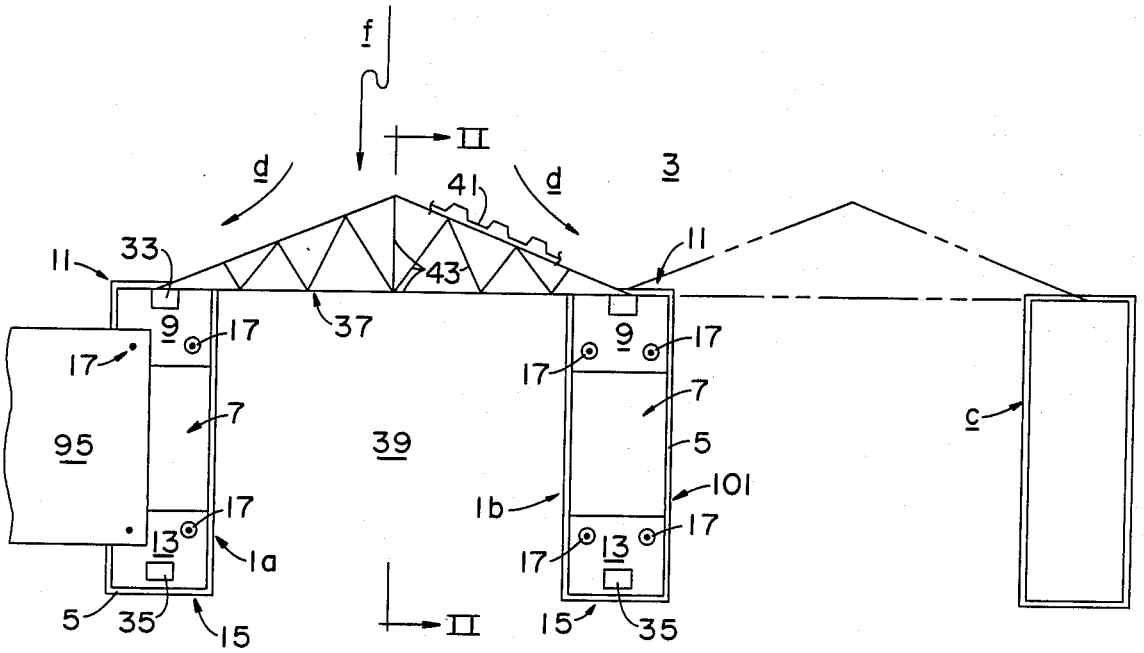
FIG. 1 is a plan view of the initial steps of construction of a section of an immersed dam foundation for use in construction of a dam according to the present invention.

Referring now to the drawings, FIG. 1 illustrates the present process with the formation of adjacent immersed laterally spaced support piers 1, designated 1*a* and 1*b*, in a body of moving water 3, the movement or flow of the body of water being in the direction of the f in FIG. 1. The support piers 1 may be constructed by known methods, such as by conventional bridge pier construction techniques. For example, sheet piling may be driven around a structural form into the floor of the body of water to form an enclosed space. The form of an enclosed space surrounded by sheet pile, cofferdam c, is shown in FIG. 1, indicating the placement of a subsequent pier for use in the present method. After dredging, driving any necessary foundation piling, and placing underwater (tremie) concrete as required, the water within the space enclosed by the sheet pile is removed and further erection of the pier, including structural concrete forming of anchor points and hold downs, and placing of temporary support posts are done in a dry state. After construction of the pier, the sheet piling may then be cut off below the water level and proximate the upper surface of the pier.

Figure 4:
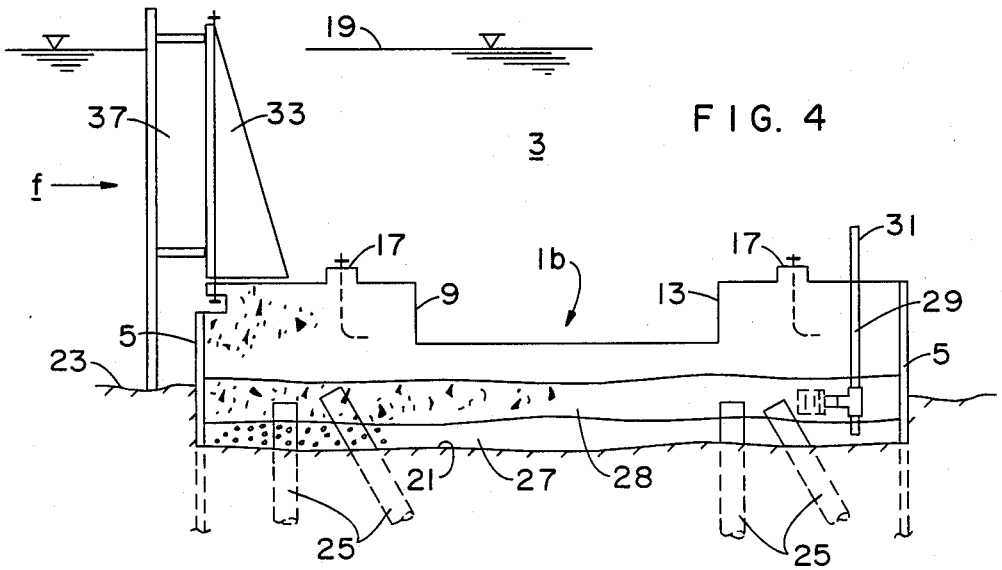
FIG. 4 is a cross-sectional view through a pier before placement of the prefabricated dam structure, taken along lines IV—IV of FIG. 3.
Figure 5:
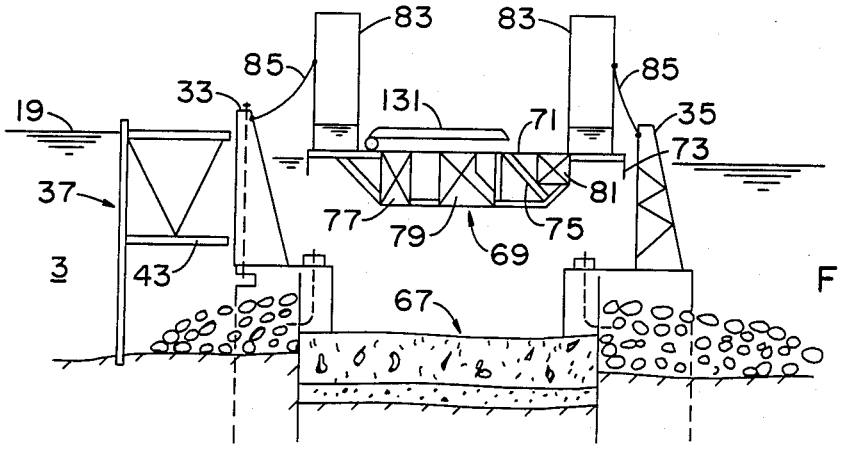
FIG. 5 is an elevational sectional view of a prefabricated dam structure being floated to a position for securement to an immersed dam foundation with control lines used to position the same.
Figure 6:
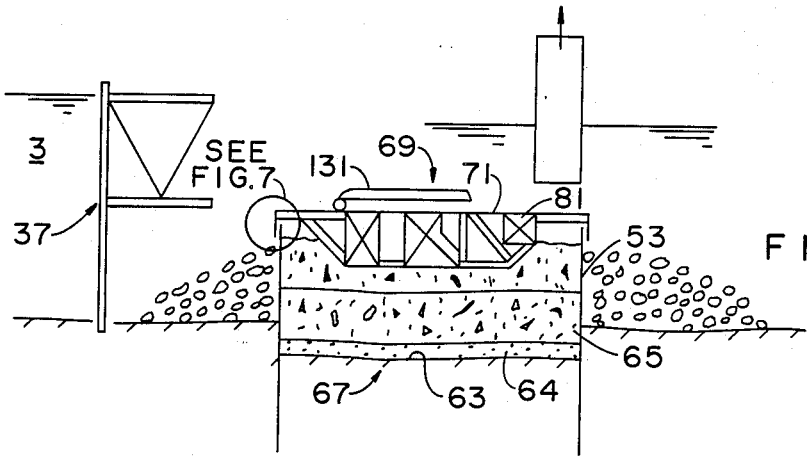
FIG. 6 is an elevational sectional view of the prefabricated dam structure shown in FIG. 5 after immersion of the same for securement to the immersed dam foundation and with tremie anchor concrete partially encasing the framework.

The piers 1*a*, 1*b* are spaced apart a predetermined distance and have pier sheet piling 5 about the periphery thereof, which piling terminates adjacent the upper surface 7 of the piers. Preferably, the piers 1*a*, 1*b* have an upper surface which has raised portion 9 at the upstream end 11 of the pier and raised portion 13 at the downstream end 15 of the pier. The piers 1*a*, 1*b* are provided with stable anchor points 17, at the upper and lower raised portions 9 and 13. The piers 1*a*, 1*b* and pier sheet piling 5 are below the surface 19 of the body of moving water (FIG. 2), which can flow freely thereover. The piers rest within a hollow 21 formed in the floor 23 of the body of moving water and may be supported, as is conventional by support piles 25 and may rest on a pervious fill 27 and tremie seal 28 in the hollow 21 (FIG. 4). As illustrated in FIG. 4, the pier 1 may be provided with a pressure relief pipe 29 which extends from the pervious fill 27 through the pier 1 and terminates at 31 in the body of moving water 3.

A first vertically extending temporary support post 33 is erected on the upstream end 11 of each pier 1 and is held in place and resists overturning, by an anchor 34 which is engaged in a recess in the raised portion 9 of the pier. A second vertically extending support post 35 is erected on the downstream end of each pier 1, both support posts extending upwardly through the surface 19 of the body of moving water 3. After the first temporary support posts 33 are erected on adjacent piers 1*a*, 1*b*, a temporary upstream current deflector 37 is installed between the adjacent piers such that current of the body of moving water, and any carried sediments and debris in the moving body of water, are deflected around the area 39 between adjacent piers, as indicated by arrows d in FIG. 1.

The current deflector 37 is supported by the adjacent first temporary support posts 33 and generally comprises sheet piling 41 and supporting framework 43, the sheet piling 41 extending from the floor 23 up through the surface 19 of the body of moving water 3.

Figure 2:
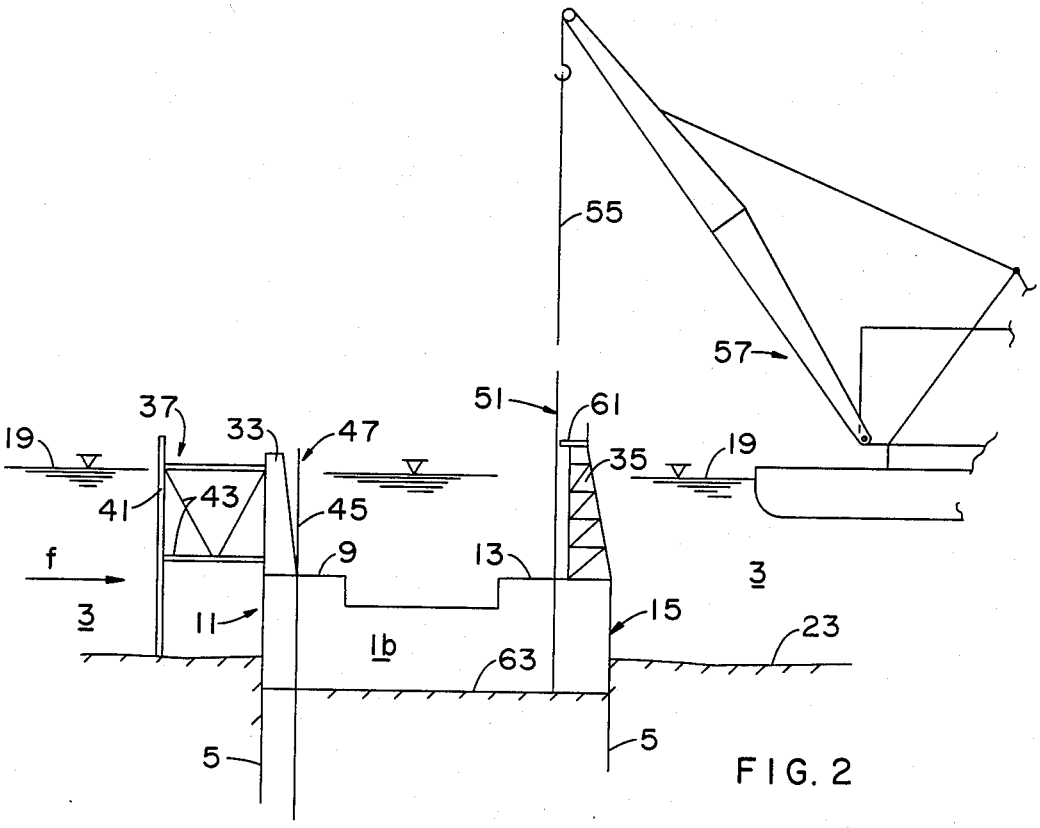
FIG. 2 is a cross-sectional elevational view taken along the lines II'II of FIG. 1.
Figure 3:
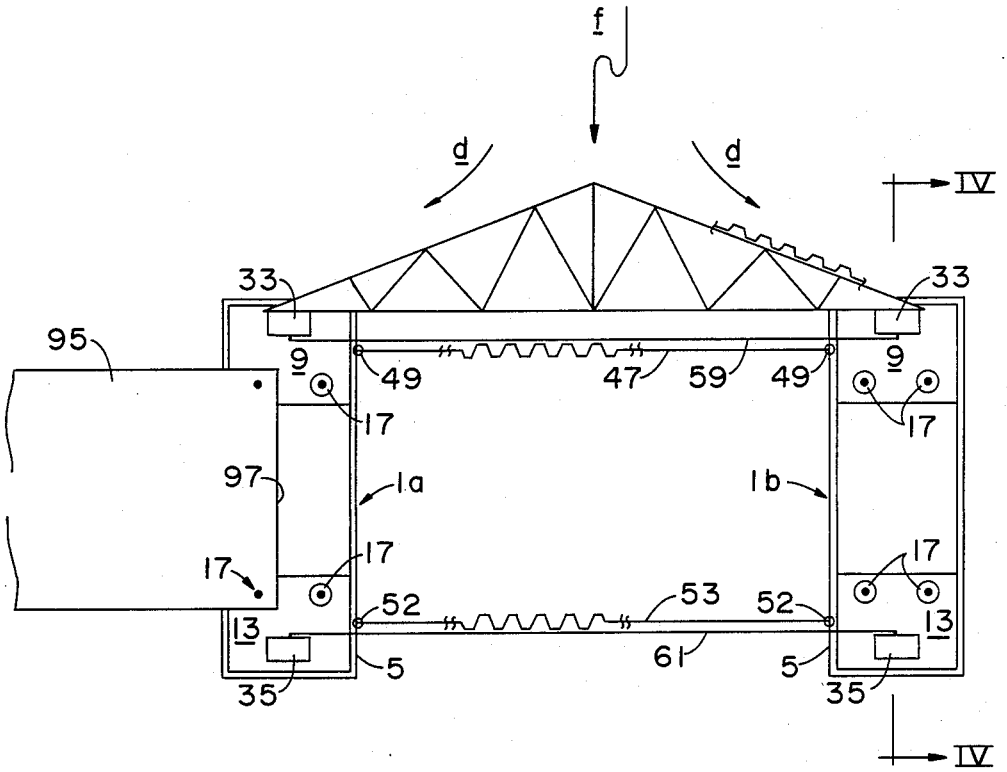
FIG. 3 is a partial view similar to that of FIG. 1 in a later stage of construction with upstream and downstream walls in place.

After installation of the temporary upstream current deflector 37, pieces of sheet piling 45 are driven into the floor 23 of the body of moving water 3 so as to form an upstream wall 47 between adjacent piers 1*a*, 1*b*, as illustrated in FIG. 2 and 3. The sheet piling 45 cooperates with the pier sheet piling 5 so as to lock the two together at 49. Pieces of sheet piling 51 are then driven into the floor 23 of the body of moving water 3 so as to form a downstream wall 53, as indicated in FIG. 2 using a driver 55 and work vessel 57, between adjacent piers 1*a*, 1*b*. The sheet piling 51 also cooperates with the pier sheet piling 5, at 52, so as to lock the two together. Alignment of the sheet piling 45 to form upstream wall 47 is effected by use of a template 59 provided between first temporary support posts 33, while alignment of the sheet piling 51 to form the downstream wall 53 is effected by use of a template 61 provided between second temporary support posts 35. Said templates 59 and 61 are formed of beams or other structural members of adequate strength and proper shape to span between the temporary support posts 33 and 35, respectively. The templates are hung on the support posts, adjusted and alignment, and temporarily fastened thereto to provide a guide for placement of the two sheet pile walls.

After formation of the upstream wall 47 and downstream wall 53, the area surrounded by these walls and the piers 1*a* and 1*b* may be dredged, if required, to form a depression, and forms a base 63 in the floor 23 of the body of moving water 3. Foundation support piling may then be driven into the base, if necessary. The base 63 is then at least partially covered with a pervious layer 64 and a tremie seal 65. The tremie seal 65 and adjacent piers 1*a* and 1*b* now serve as an immersed foundation 67 for a dam to be constructed thereon.

To complete a dam section, by addition of a sill or dam structure to the immersed foundation 67, the upstream wall 47 and downstream wall 53 are cut off at a location adjacent the upper surface 7 of the piers 1*a* and 1*b*, including raised portions 9 and 13. A prefabricated dam structure 69, as schematically illustrated in FIGS. 5 to 8 is then floated to a location above the foundation and secured thereto. The immersed foundation 67 includes the tremie seal 65 and facing portions of the support piers 1*a*, 1*b*, including a pair of anchor points 17. An especially useful type of prefabricated dam structure is that described in the aforementioned patents issued to Jean Aubert, especially U.S. Pat. Nos. 3,720,067 and 3,938,342, the contents of both patents incorporated by reference herein. As described therein, and illustrated in the present drawings, a prefabricated dam structure 69 preferably has a platform 71 with downwardly extending sides 73. The platform 71 has a structural framework 75 depending therefrom which provides support for the platform and is later encased in concrete and also defines chambers or galleries, such as an access gallery 77 and a cylinder service gallery 79. A flotation tank 81 may also be supported by the framework 75, and flotation control tubes 83 may be provided on the platform to enable floating of the prefabricated dam structure to a location above the tremie seal 65 and spanning portions of adjacent support piers. The temporary support posts 33 and 35, can be used to position the prefabricated dam structure 69 by use of control means, such as guide wires 85, attached to either or both of the pairs of temporary support posts and the prefabricated dam structure, such as by attachment to the flotation control tubes 83.

Figure 7:
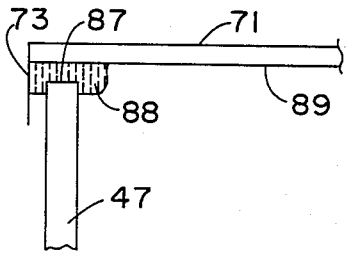
FIG. 7 is an enlarged view of the area in the circle shown in FIG. 6.
Figure 8:
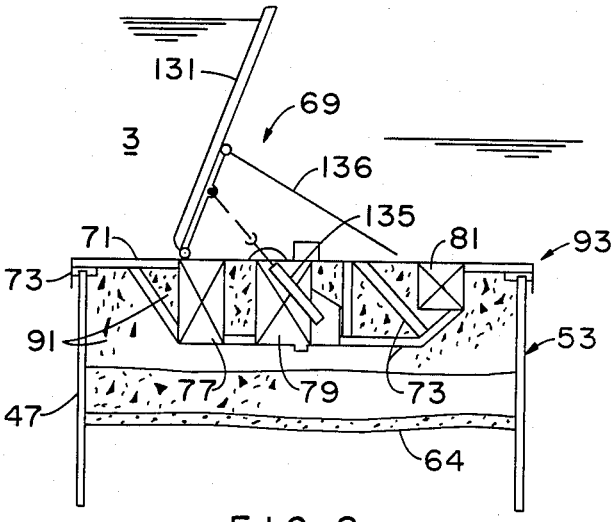
FIG. 8 is an elevational sectional view of the prefabricated dam structure secured to the tremie seal of the dam foundation between two adjacent piers.
Figure 9:
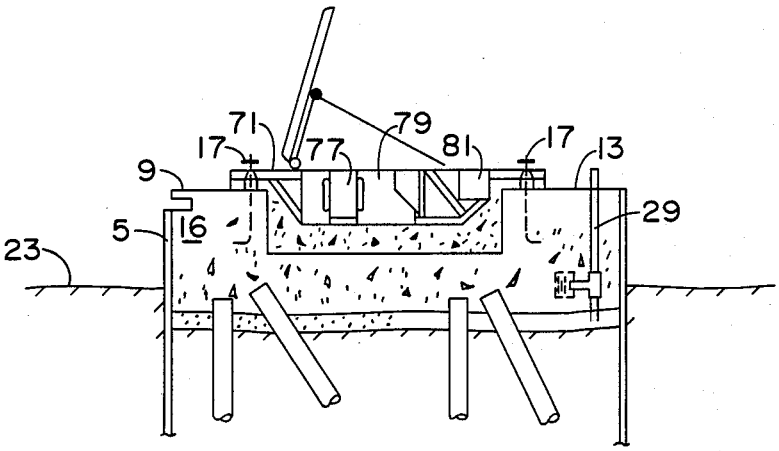
FIG. 9 is an elevational sectional view of the prefabricated dam structure secured to a pier of the dam foundation.

When the prefabricated dam structure 69 is positioned above the tremie seal 65 and over confronting portions of piers 1*a* and 1*b*, lowering of the prefabricated dam structure onto the immersed dam foundation 67 is effected, with the downwardly extending sides 73 of platform 71 positioned adjacently outside the cutoff edges 87 of upstream wall 47 and downstream wall 53. Vertical control during this operation will be achieved by progressive flooding of the control tubes and/or by lowering winches attached to each of the four temporary support posts. As shown in FIG. 7, a crushable seal, such as a foamed thermoplastic form 88, may be disposed between the cutoff edge 87 of a wall, such as upstream wall 47, and the lower surface 89 of the platform 71 adjacent the downwardly extending side 73 to provide a seal for subsequent tremie and grout filling of the framework 75 of the prefabricated dam structure. The tremie and grout 91, by known procedures, is charged into the openings in framework 75 and secures the same in place, as illustrated in FIG. 8 to form a dam section 93.

A previous dam section 95 is shown in FIGS. 1 and 3, with an end 97, and with construction of dam section 93 then effected. The use of the stable anchor points provides precise vertical and horizontal alignment of the dam sections to form a dam. The temporary support post and temporary current deflector is removed after completion of a pair of adjacent sections of the dam on a pier, but may be reinstalled anytime during dam life for maintenance during high water flow.

Figure 10:
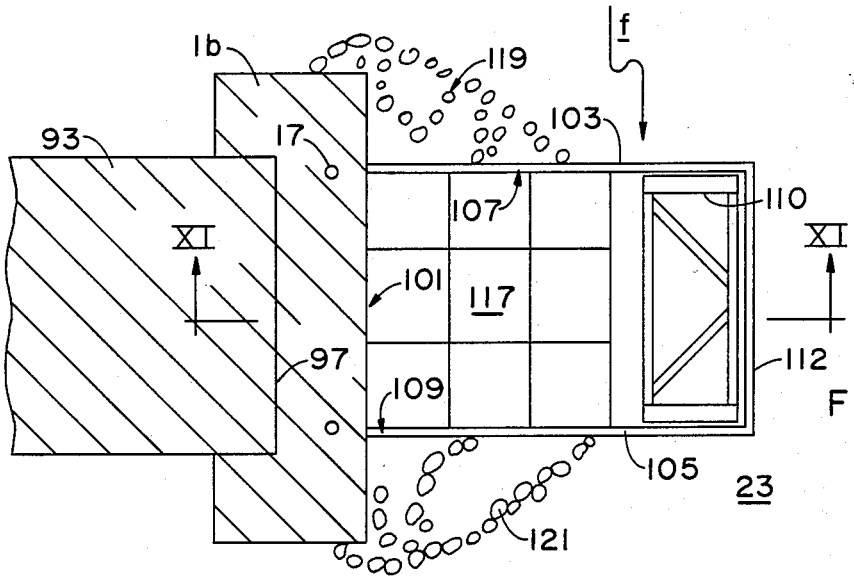
FIG. 10 is a plan view of a pier with a temporary exposed face with erosion protection provided for the exposed face.
Figure 11:
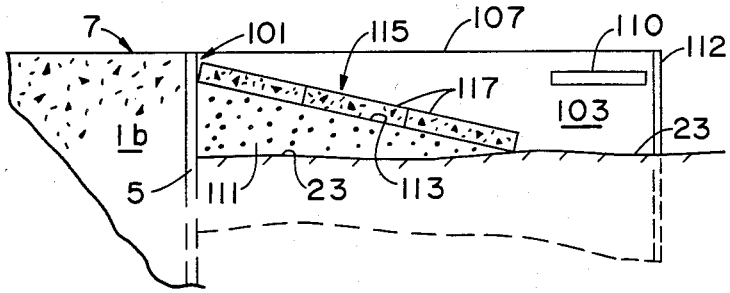
FIG. 11 is an elevational sectional view taken along the lines XI—XI of FIG. 10.

In the event that construction of a dam across a body of moving water must be interrupted for a period of time, such as due to seasonal conditions, it is important that the pier which will serve as one hard point for a following dam section, and the floor of the body of moving water adjacent thereto, be protected. In the present method, the floor of the body of moving water is protected from scouring in a manner that allows for easy formation of upstream and downstream walls between a pier, having a face exposed to the currents, and an adjacent pier When conventional methods of protection such as a supply of riprap about the pier or timber mattresses are used, it becomes impractical to remove all of the pieces in order to drive sheet pile to form the subsequent upstream and downstream walls for placement of the next prefabricated dam structure. The present method, however, uses sheet pile barriers, which will serve as a section of the next upstream and downstream walls, and a supply of gravel, with covering therefor, between the barriers For example, in FIGS. 10 and 11, the completed dam section 93 is illustrated with pier 1*b* being in condition for extension of the dam towards a pier that is to be built in cofferdam c as illustrated in FIG. 1. In FIG. 10, the floor 23 of the body of moving water would tend to be seriously eroded and a depression formed adjacent the exposed face 101 of the pier, by action of the currents of the body of moving water, since the exposed face is not protected by a current deflector. An upstream sheet pile barrier 103, which will serve as a section of the next upstream wall 47 between adjacent piers, is driven into the floor 23, and a spaced downstream sheet pile barrier 105, which will serve as a section of the next downstream wall 53 between adjacent piers, also driven therein, in a direction parallel to the dam section 93 and adjacent to and extending outwardly from the exposed face 101 of the pier 1*b*, the top edges 107 and 109 respectively of barrier 103 and 105 being adjacent the upper surface 7 of the pier 1*b*. A stabilizing frame 110 may be positioned between the upstream and downstream sheet pile barriers 103, 105, and a crosswall 112 provided to close off the ends of the sheet pile barriers and to provide stability therefor in the direction of flow of the body of moving water. A layer of gravel 111 is then deposited between the sheet pile barriers 103 and 105, the layer of gravel 111 having a sloped face 113 extending downwardly from the exposed face 101 towards the floor 23 of the body of moving water, as shown in FIG. 11. On the sloped face 113 of the gravel 111, there is then placed a concrete cover 115, illustrated as contiguous concrete pads 117. The concrete pads may have permanently attached cables for placement and removal thereof from the gravel surface. A first supply of riprap 119 is then deposited on the upstream side of the upstream sheet pile barrier 103 and a second supply of riprap 121 is deposited on the downstream side of the downstream sheet pile barrier 105. The barriers 103, 105 will extend a sufficient distance so as to prevent the riprap from entering the area between the barriers.

When construction of the upstream and downstream walls 47 and 53 is to be effected, the barriers 103 and 105 serve as a portion of these respective walls.

Figure 12:
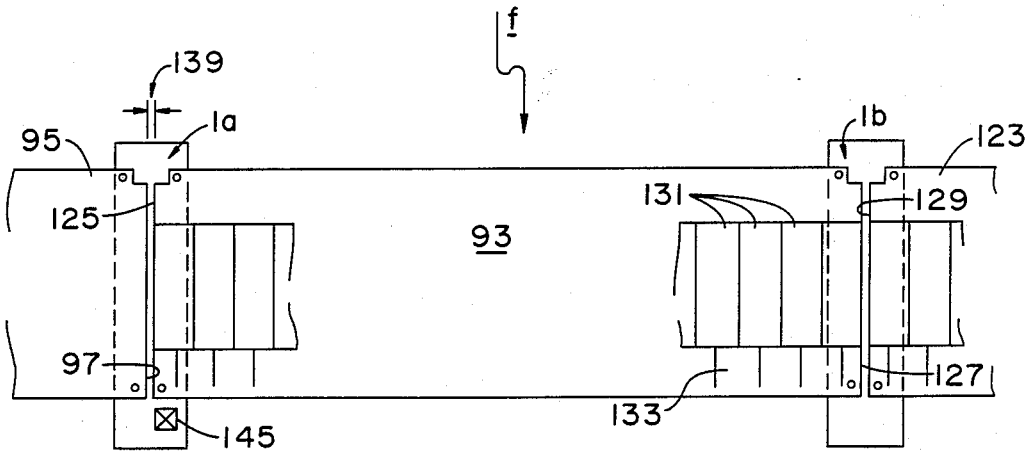
FIG. 12 is a partial plan view of three dam sections of a dam constructed according to the present method showing the wickets and hurter thereof.
Figure 13:
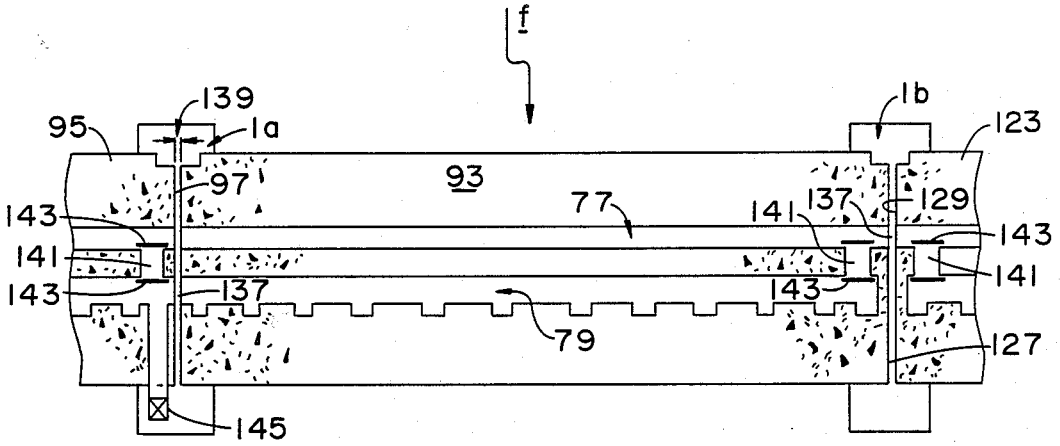
FIG. 13 is a horizontal cross-sectional view of the dam illustrated in FIG. 12 showing the access and cylinder access galleries and the seals therebetween.

A completed section of an embodiment of a dam, as constructed according to the present method is illustrated in the plan views of FIGS. 12 and 13 after removal of the temporary support posts and the temporary current deflector. Dam sections 95 and 93 are shown supported by pier 1*a*, while pier 1*b* supports the other end of dam section 93 and a subsequently constructed dam section 123. Dam section 93 has one end 125 which faces the end 97 of previous dam section 95 and another end 127 which faces an end 129 of subsequently constructed dam section 123. Preferably, each dam section 95, 93 and 123 has self raising wickets 131 or other type of movable gate, as are conventionally available, and a typical hurter section 133. The self raising wickets 131 are actuated by hydraulic cylinders 135 (FIG. 8) which are disposed in the cylinder service gallery 79, while rods 136 coacting in the hurter support the self raising wickets 131.

In order to better effect maintenance of the components of the dam, the access galleries 77, which extend the length of the dam section, and cylinder service galleries 79, which also extend the length of the dam section, are provided in each section. By precision alignment of the dam sections 95, 93, 123, the access galleries 77 and cylinder service galleries 79 are precisely aligned in closely spaced alignment. The access galleries 77, since they will normally be under water, must be kept sealed from the environment. An access gallery seal 137 is provided across the gap 139 between adjacent dam sections. Such a seal 137 may also be provided between adjacent cylinder service galleries 79. Connecting passageways 141 may be provided between an access gallery 77 and cylinder access gallery 79 of a dam section, which are sealed by movable closures 143. The movable closures 143 comprise a pair of watertight bulkheads, each pair of which form a watertight lock for safety. A watertight access hatch 145 is provided, preferably on alternate piers, which can receive a diver-placed access tube extending above water for dry access during maintenance operations.

Figure 14:
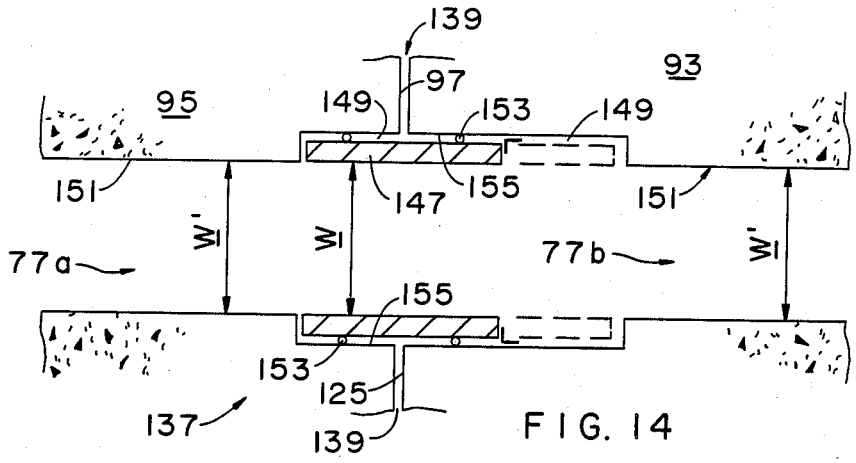
FIG. 14 is a schematic view, partly in section, of one embodiment of a seal between galleries of adjacent dam sections of the dam.
Figure 15:
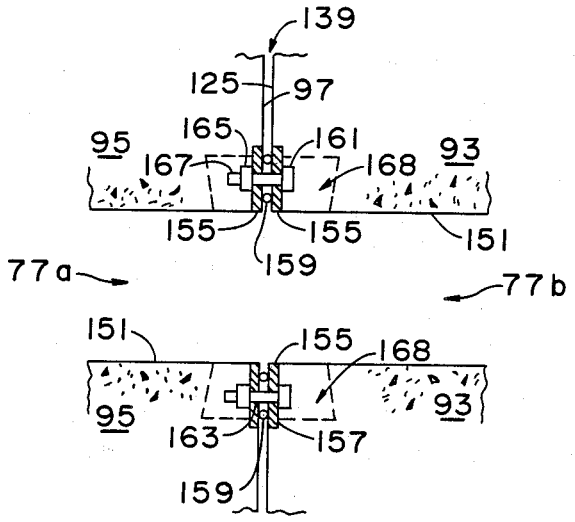
FIG. 15 is a schematic view partly in section, of another embodiment of a seal between galleries of adjacent dam sections of the dam.
Figure 16:
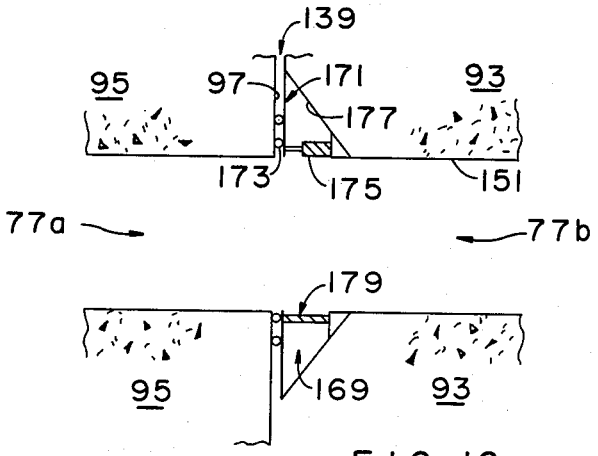
FIG. 16 is a schematic view, partly in section, of a further embodiment of a seal between galleries of adjacent dam sections of the dam.

Various embodiments of seals 137 are illustrated in FIGS. 14, 15 and 16, which illustrate sections through adjacent dam sections 93 and 95, wherein access galleries 77*a* and 77*b* are interconnected. FIG. 14 illustrates a slidable conduit 147 the interior diameter of which conforms generally to the interior dimensions w' of the access galleries 77*a* and 77*b*, and which is contained in recesses 149 formed in the walls 151 of the access galleries. The slidable conduit 147 is initially contained in the recess 149 of one wall 151 of a dam section 93 illustrated in dashed lines, and is slidable into the recess 149 of an adjacent dam section 95 such that the slidable conduit 147 faces the gap 139. Inflatable seals 153 may be temporarily used to seal the space between the slidable conduit 147 and the wall 155 of recess 149. After the temporary inflatable seals 153 are in place, grout or other sealing material (not shown) may be forced into the gap 139 to seal the same.

Another embodiment of a seal 137 is illustrated in FIG. 15, wherein connecting bolts and compressed rubber seals are provided. Metal flanges 155 are provided around the inner region of gap 139, the flanges secured in shoulders 157 formed in the ends 97, 125 of adjacent dam section 95, 93. Compressible rubber seals 1159 are positioned between the flanges 155, and connecting bolts 161 pass through apertures 163 in the flange 155 Nuts 165 are threadably engaged on threads 167 on the connecting bolts 161, in a recess 168 in the dam sections 95, 93, to pull the flanges 155 together to compress rubber seals 159 and temporarily seal the gap 139, until grout or other sealing material is inserted into the gap between the rubber seals and the outer walls of the dam section.

A further embodiment of a seal 137 is illustraed in FIG. 16. A channel 169 is formed in the wall 151 at the end of one of the dam sections, such as 93, which communicates with the area between access galleries 77*a* and 77*b*. A flexible member 171 is provided about the channel 169, confronting the facing end 97 of adjacent dam section 95, with compressible seals 171 disposed beween end 97 and flexible member 171. Jacks 175, positioned between channel wall 177 and the flexible member 171, are provided to force the flexible member 171 against compressible seals 173 to seal the gap 139, until permanent shims 179 and/or bolted seals are used to compress the compressible seals 173, and grout or other sealing material can be placed in the gap between the flexible member and the outer walls of the dam section.

Figure 17:
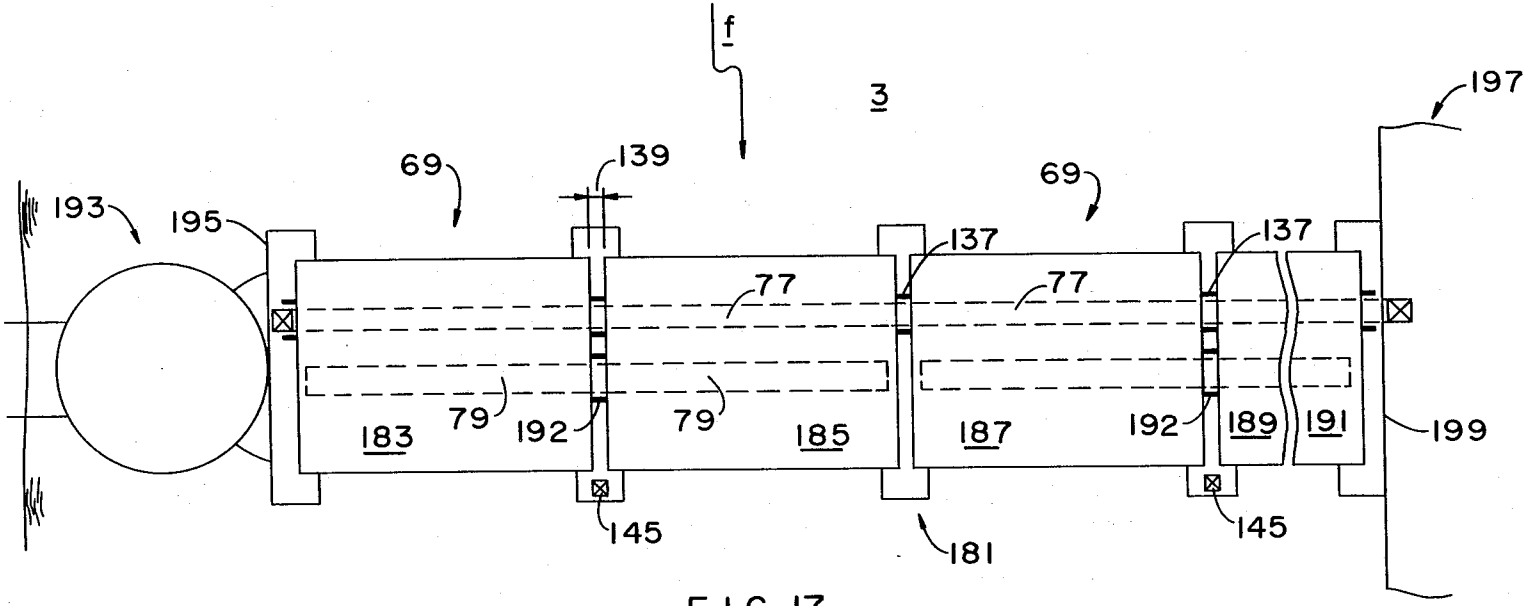
FIG. 17 is a plan view, with water removed above, of a dam constructed according to the method of the present invention.

A dam formed by the method of the present invention is illustrated in FIG. 17. A dam 181 is illustrated having prefabricated dam structures 69, forming dam sections 183, 185, 187, 189 and 191, which are secured between adjacent piers 1. The access galleries 77 of adjacent prefabricated dam structures 69 are connected by access gallery seals 137. The prefabricated dam structure also has cylinder service galleries 79, pairs of which may be connected by seals 192. The dam 181, as is conventional, will extend across the body of moving water 3, such as a river, from an abutment 193, such as a non-overflow weir, at one end 195, to an abutment 197, such as a lock, at the other end 199. As an example of the relative dimensions of a dam constructed according to the present method, it is envisioned that the piers would be only about twenty percent or less of the overall length of the dam 181. For example, the piers may be about 25 feet in width, across the river, and 80 feet in length, in the direction of flow of the river. The prefabricated dam structures 69, would be on the order of 140 feet wide and about 40 to 45 feet in length. The gaps 139 between adjacent prefabricated dam structures 69 would be on the order of 4 inches wide, which gaps are sealed between the access galleries 77 by access gallery seals 137.

As has been described, the present method provides for the construction of an immersed dam foundation in a body of moving water and a dam structure thereon, without the need for large cofferdams, using prefabricated units, while precisely aligning the units and permitting passage thereby during the construction.

What is claimed is:

1. A method of constructing an immersed dam foundation, in a body of moving water having a floor, and of forming a dam structure thereon, without the requirement for large cofferdams that block large portions of the body of water for long time periods, comprising:

forming a plurality of laterally spaced support piers, having upstream and downstream ends, below the surface of the body of moving water, the piers having spaced stable anchor points thereon, and sheet piling about the perimeter thereof;

constructing a first temporary support post on the upstream end of each pier and a second temporary support post on the downstream end of each pier;

installing a temporary upstream current deflector between adjacent piers, whereby the current, and any carried sediments or debris in the body of moving water, are deflected around the area between said adjacent piers, said current deflector supported by adjacent said first temporary support posts;

driving sheet pile into the floor to form an upstream wall between said adjacent piers proximate said first temporary support posts;

driving sheet pile into the floor to form a downstream wall between said adjacent piers proximate said second temporary support posts;

the area surrounded by said adjacent spaced piers and said upstream and downstream walls forming a base in said floor;

at least partially covering the base with a tremie seal, such that said tremie seal and adjacent piers serve as an immersed dam foundation;

cutting off at least one of said upstream and downstream walls substantially flush with said adjacent piers;

floating a prefabricated dam structure to a location above said tremie seal and lowering said prefabricated dam structure such that the same rests on the stable anchor points of said adjacent piers; and securing said prefabricated dam structure to said adjacent piers and tremie seal with structural tremie concrete to form said dam.

2. The method as defined in claim 1 wherein said upstream and downstream ends of said piers have raised portions thereon and said stable anchor points are provided on said raised portions.

3. The method as defined in claim 1 wherein a template is provided between the first temporary support posts of the adjacent piers, and sheet pile is aligned thereby during driving of the sheet pile to form said upstream wall.

4. The method as defined in claim 3 wherein a template is provided between the second temporary support posts of the adjacent piers, and sheet pile is aligned therewith during driving of the sheet pile to form said downstream wall.

5. The method as defined in claim 4 wherein said base is dredged to form a depression and said depression is at least partially filled by said tremie seal.

6. The method as defined in claim 4 wherein control means, attached to at least one of said temporary support posts, are provided to position the prefabricated dam structure to said location above the tremie seal and spanning adjacent support piers.

7. The method as defined in claim 1 wherein said prefabricated dam structure has a platform and downwardly extending sides, said platform is positioned above said tremie seal with said downwardly extending sides adjacently outside said upstream and downstream walls, and a crushable seal is disposed of the cutoff edge of at least one of said upstream and downstream walls which forms a seal between the lower surface of the platform and the said wall.

8. The method of claim 7 wherein said crushable seal is formed from a foamed thermoplastic material.

9. The method as defined in claim 1 wherein an exposed face of a pier, exposed to currents of the body of moving water, is protected by driving an upstream sheet pile barrier and a downstream sheet pile barrier into the flow of the body of moving water, adjacent to and extending outwardly from said exposed face, the top edges of said barriers adjacent the upper surface of the pier, which barriers serve as a portion of subsequently formed upstream and downstream walls; depositing a layer of gravel between the sheet pile barriers, the layer of gravel forming a sloped surface extending downwardly from said exposed face of the pier to said floor; and placing a concrete cover on the sloped surface of the layer of gravel.

10. The method as defined in claim 9 wherein said concrete cover is formed from contiguous concrete pads.

11. The method as defined in claim 10 wherein a first supply of riprap is deposited on the upstream side of the upstream sheet pile barrier, and a second supply of riprap is deposited on the downstream side of the downstream sheet pile barrier.

12. The method as defined in claim 1 wherein said dam is formed of prefabricated dam structure sections, said sections having movable gates thereon operated by cylinders and each section has an access gallery therein and a cylinder service gallery therein, said galleries extending the length of the dam section.

13. The method as defined in claim 12 wherein said access gallery is normally below the surface of the body of moving water after construction of said dam.

14. The method as defined in claim 13 wherein a connecting passageway is provided between an access gallery and a cylinder service gallery of the prefabricated dam structure section, and movable closures are provided to seal said passageway.

15. The method as defined in claim 14 wherein each connecting passageway has a pair of watertight bulkheads which will allow access to the galleries, even if one is dry and the other filled with water.

16. The method as defined in claim 13 wherein adjacent dam sections are positioned with access galleries thereof in closely spaced aligned relationship to leave a gap therebetween, and an access gallery seal is provided across the gap between adjacent said access galleries.

17. The method as defined in claim 16 wherein recesses are formed in the walls of said access galleries, a slidable conduit is contained in a recess of adjacent prefabricated dam sections, said slidable conduit is moved to face a gap beween said adjacent prefabricated dam sections, and inflatable seals are used to seal the space between the slidable conduit and the walls of the recesses.

18. The method as defined in claim 17 wherein, after said temporary inflatable seals are in place, grout is forced into the gap between the adjacent prefabricated dam sections to seal the same.

19. The method as defined in claim 16 wherein shoulders are formed in the ends of adjacent dam sections and metal flanges are secured on said shoulders, compressible rubber seals are positioned between said flanges, and connecting bolts are used to compress said rubber seals to seal the gap between said adjacent dam sections.

20. The method as defined in claim 19 wherein, after compression of said rubber seals, a sealing material is forced into the gap between the adjacent dam sections to seal the same.

21. The method as defined in claim 16 wherein a channel is formed in the wall at one end of a dam section, a flexible member is provided about the channel, and compressible seals are compressed between said flexible member and the end of the adjacent dam section to seal the gap between said adjacent dam sections.

22. The method as defined in claim 21 wherein said compressible seals are compressed by use of jacks positioned between a channel wall and said flexible member.

23. The method as defined in claim 22 wherein after initial compression of said compressible seals, permanent shims are used to compress said compressible seals and said jacks are removed.

* * * * *